United States Patent [19]

Knochel

[11] 4,387,891

[45] Jun. 14, 1983

[54] WALKER

[76] Inventor: E. Stanley Knochel, 4202 Glenmore Ave., Baltimore, Md. 21206

[21] Appl. No.: 212,113

[22] Filed: Dec. 2, 1980

[51] Int. Cl.[3] ..... A61H 3/00

[52] U.S. Cl. ..... 272/70.3; 135/67

[58] Field of Search ..... 135/67, 65, 66, 85; 272/70.3, 70.4; 280/1.181, 1.186, 28.5, 218, 219, 242 R, 642, 647, 648, 43.24, 87.02 R, 87.02 W, 87.04 R, DIG. 10; 297/5, 6; D12/128, 129, 130; 301/104; 172/557, 540, 534; D3/7, 8, 9

[56] References Cited

U.S. PATENT DOCUMENTS

| | | | |
|---|---|---|---|
| D. 104,018 | 4/1937 | Cole | 172/540 X |
| 377,392 | 2/1888 | King | 172/540 X |
| 545,545 | 9/1895 | Spitzenberg | 172/540 |
| 635,685 | 10/1899 | Holloway | 172/540 X |
| 679,750 | 8/1901 | Hoffmann | 280/43.24 |
| 1,551,127 | 8/1925 | Whyel | 280/DIG. 10 X |
| 2,843,180 | 7/1958 | Schwartz | 272/70.3 |
| 4,018,440 | 4/1977 | Deutsch | 272/70.3 |
| 4,251,105 | 2/1981 | Barker | 135/67 X |

FOREIGN PATENT DOCUMENTS

| | | | |
|---|---|---|---|
| 401711 | 9/1924 | Fed. Rep. of Germany | 135/85 |
| 978587 | 12/1964 | United Kingdom | 272/70.3 |

*Primary Examiner*—Richard C. Pinkham
*Assistant Examiner*—Arnold W. Kramer
*Attorney, Agent, or Firm*—Shlesinger, Arkwright, Garvey & Dinsmore

[57] ABSTRACT

A walker including a frame, the forward portion of which is provided with rotary members at its lower end for advancing the walking aid. The rotary members comprise 2 spoked wheels fixed to the ends of and rotatable with an axle, the spokes of the rotary members being out of phase to advance the walking aid in a step-by-step fashion in response to the shifting of weight by the patient from one side of the frame to the other.

8 Claims, 4 Drawing Figures

WALKER

BACKGROUND AND OBJECTS OF THE INVENTION

This invention relates to a walker or walking aid which is used by patients. More particularly, this invention relates to self-supporting walkers which support the weight of a patient and which can be forwardly advanced by the patient without the need for lifting the walker from the supporting surface.

Typically, walking aids have been constructed of a standing metal frame supported on legs permitting an invalid patient to steady himself in a standing position while holding the upper portion of the walker frame. Walking with the prior art walkers is effected by sliding the walker along the ground or by intermittently lifting the walker as the patient walks forward. In the past, many invalid patients have had difficulty in lifting or sliding the walking aid due to physical weakness. It has been found desirable to provide a walker which will support an unsteady invalid patient but will permit the patient to walk forward without the need for lifting the walking aid. To this end, rolling walking aids such as disclosed in U.S. Pat. No. 4,046,274 to Breyley have been devised, as well as pivoting walkers represented by U.S. Pat. No. 3,165,112 to Ries. Both of these prior art improvements, however, still require that the patient at least partially lift the walker frame, and thus the need still exists for a walker which can be used by patients who are unable to lift their walker and need to continually support their weight on the walker frame.

It is therefore one object of the present invention to provide a walker which is self-advanced by a patient merely shifting his weight from one side of the walker to the other without the necessity of lifting the walker.

It is another object of the present invention to provide a walker which is provided with supporting spoked wheels on each side of the walker which operate synchronously to advance the walker as a patient's weight is shifted from side to side.

It is still another object of the present invention to provide a walker which is provided with spoked wheels for advancing the walker a predetermined distance in a step-by-step fashion and will not inadvertently "runaway" from the patient.

It is a further object of the present invention to provide a walker which is provided with spoked wheels for advancing the walker a specified distance determined by the circumferential distance between adjacent spokes.

It is still another object of the present invention to provide a walker of the character described wherein the spoked wheels are replaceable with spoked wheels of different size, thereby providing a different, predetermined advancing distance best suited for the height and walking ability of a patient.

It is a still further object of the present invention to provide a walker which allows invalid patients to begin walking with the use of an aid sooner than is possible with conventional walking aids.

In order to carry out the objects of the invention, the spoked wheels are fixedly attached to both ends of an axle which in turn is rotatably connected to removable and adjustable lower front leg portions of the frame. The spoked wheel assembly, including the wheels, axle and lower front leg portions, is thereby removable as a unit to permit replacement with spoked wheels having different length spokes and/or a different number of spokes depending on the height and walking ability of a patient.

DETAILED DESCRIPTION OF THE INVENTION

Figure 1:
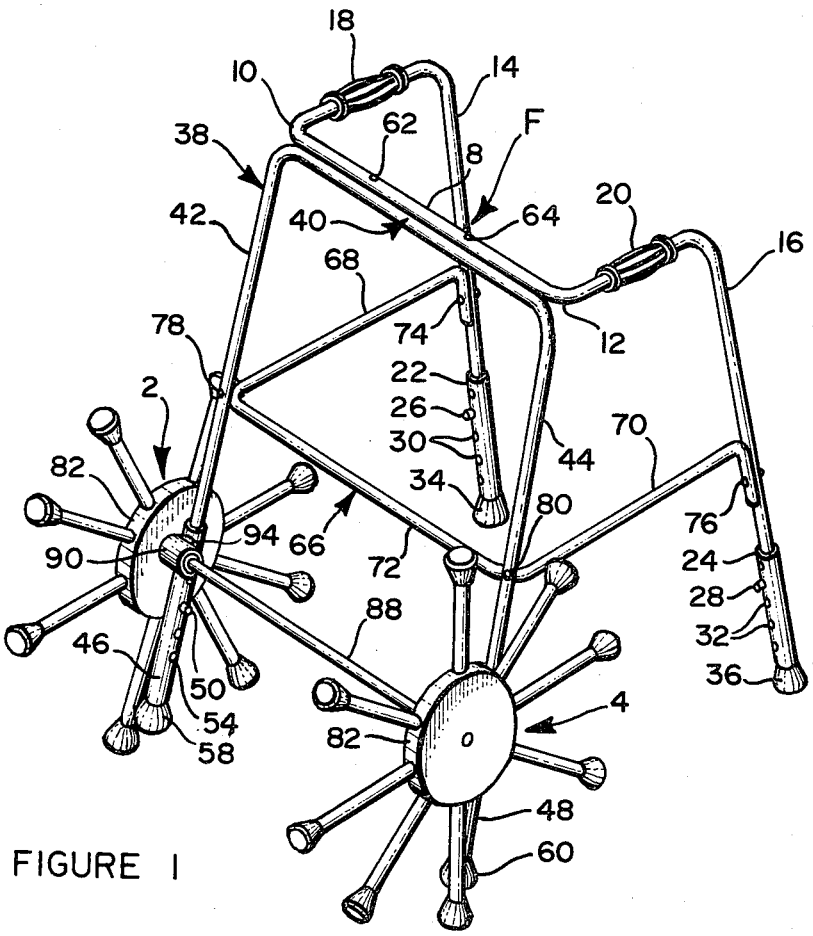
FIG. 1 is a perspective view of the walker of the present invention.
Figure 2:
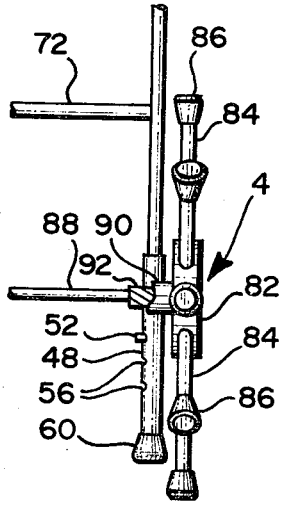
FIG. 2 is a fragmentary front elevational view of the present invention, a portion thereof being broken away to disclose details.

The walker of the present invention comprises a frame F having two spoked, ground-engaging wheels 2 and 4 connected to a lower front portion thereof for advancing the walker forwardly in a step-by-step fashion. The walker is preferably of lightweight metal construction such as aluminum or magnesium.

Frame F is of generally conventional construction and includes a rear frame member 6 of one continuous conformed piece of light tubular metal formed to provide a forward transverse horizontal section 8, the ends of which extend rearwardly to provide opposed horizontal side bars 10 and 12. Legs 14 and 16 extend downwardly from the aft end of side bars 10 and 12. Hand grips 18 and 20 are attached to horizontal bars 10 and 12 intermediate their length to provide comfortable gripping means for the person using the walker.

In order to adjust the height of the walker, tubular rear leg extensions 22 and 24 are telescopically engaged with rear legs 14 and 16. The rear leg extensions 22 and 24 are longitudinally positioned with respect to rear legs 14 and 16 by means of spring actuated pins 26 and 28 carried by rear legs 14 and 16 for selective engagement with a series of vertical positioning holes 30 and 32 in the periphery of the tubular rear legs. The height of rear frame member 6 is thereby easily adjusted by selectively positioning spring actuated pins 26 and 28 within the appropriate positioning holes 30 and 32 to provide the most comfortable height walker for the size of the individual user. The rear leg extensions 22 and 24 are also provided with tips 34 and 36 made of rubber or similar non-skid material to provide feet on which the walker may rest, which feet will grip the floor or ground surface to prevent the walker from inadvertently sliding.

Frame F further includes a front frame member 38 of inverted U-shape comprising a horizontal section 40, the ends of which extend downwardly to provide spaced front legs 42 and 44. Tubular front leg extensions 46 and 48 are telescopically engaged with front legs 42 and 44, and are similar to rear leg extensions 22 and 24. Front leg extensions 46 and 48 are positioned by means of spring actuated pins 50 and 52 carried by front legs 42 and 44 for selective engagement with a series of vertical positioning holes 54 and 56 in the periphery of the tubular front leg extensions 46 and 48. Tips 58 and 60 attached to the lower ends of extensions 46 and 48 serve as the front feet of the walker.

The generally rectangular shape of the walker is created when rear frame member 6 and front frame member 38 are secured together at 62 and 64 by screws, bolts or other suitable means. In addition, a generally U-shape support frame 66 disposed in a horizontal plane serves to secure together the lower portion of rear frame member 6 and front frame member 38. U-shape support frame 66 includes side support members 68 and 70 extending between rear legs 14 and 16 and front legs 42 and 44, and intermediate support member 72 which extends between front legs 42 and 44. U-shape support frame 66 is secured to the walker by screws, bolts or other suitable means as indicated at 74, 76, 78 and 80.

In accordance with the salient features of the present invention, spoked wheels 2 and 4 are positioned on either side of the frame front portion to provide means for advancing the walker forwardly in a step-by-step process which approximates the forward movement of a conventional walker, but without the necessity of lifting the walker off the ground as the user advances forward.

Spoke wheels 2 and 4 each include a circular hub 82 from which a plurality of equally spaced tubular metal spokes 84 extend radially. Tips 86 of rubber or other non-skid material are fixed to the outer ends of spokes 84 for engagement with the surface on which the walker is placed. The number and size of spokes 84 may vary depending upon the requirement of the walker as described hereinafter. It will be noted, however, that spoked wheels 2 and 4 are matched in size and have the same number of spokes in order to operate in accordance with the objects of the present invention.

In accordance with the present invention, an axle 88 extends transversely of the front portion of the walker, the ends of which axle are fixedly secured to the center of hubs 82 of spoked wheels 2 and 4 in order to effect synchronous rotation of the axle and spoked wheels. The spoked wheels and axle are attached to the walker by means of sleeves 90 having sleeve bearings 92 in which axle 88 is free to rotate. Sleeves 90 are welded or secured in any other suitable fashion to the front of front leg extensions 46 and 48 as indicated at 94. The attachment of axle 88 to the front leg extensions enables a downward force on the walker frame to be translated into a downward force on the spoked wheels, causing the later to rotate and advance forwardly. The entire wheel assembly, including hub wheels 2 and 4, axle 88, sleeves 90 and front leg extensions 46 and 48 is removable from the walker as a unit, thereby permitting replacement with a different size wheel assembly particularly adapted for the individual user.

Figure 3:
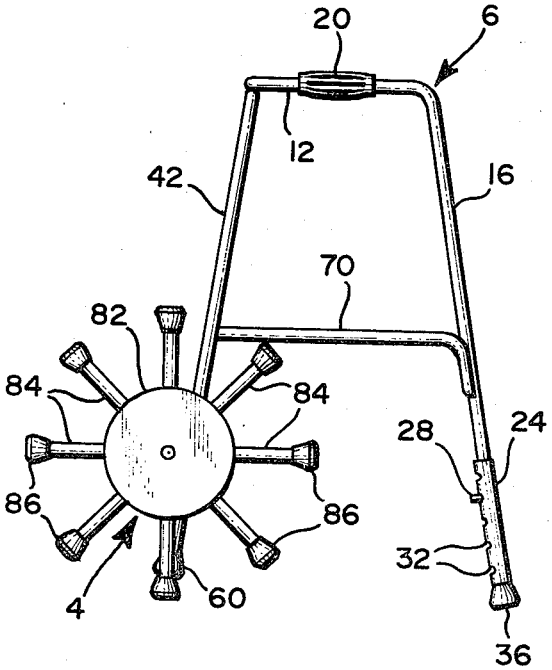
FIG. 3 is a side elevational view of the walker taken from one side thereof.
Figure 4:
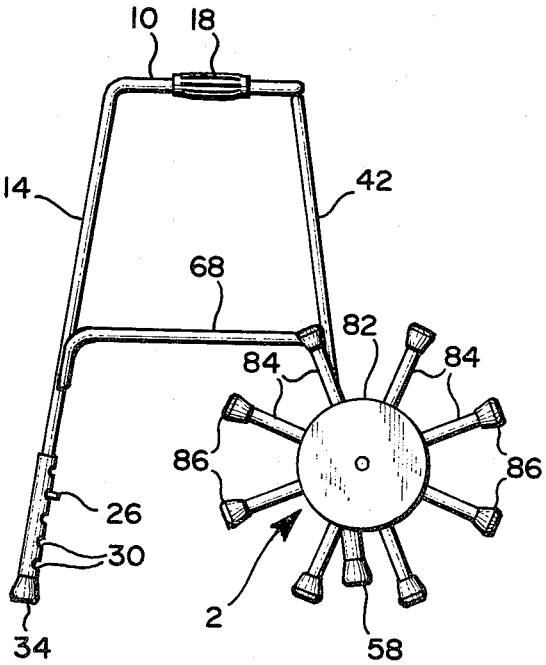
FIG. 4 is a side elevational view of the walker taken from the opposite side of the walker shown in FIG. 3.

The positioning of spoked wheels 2 and 4 on front leg extensions 46 and 48 is shown to advantage in FIGS. 3 and 4, from which it will be noted that, when a spoke 84 of one hub 82 is in perpendicular engagement with the ground, the adjacent tip 58 or 60 of leg extensions 46 and 48 will be spaced from the ground a distance approximately equal to the height of one of the tips. At that time, the opposite tip 58 or 60 adjacent spokes 84 which angularly engage the ground will also be in engagement with the ground.

In order to advance the walker in step-by-step fashion, spoked wheels 2 and 4 are out of phase with respect to each other, as shown to advantage in FIGS. 3 and 4. In other words, when one of the spokes 84 of wheel 4 is perpendicularly engageable with the ground, as shown in FIG. 3, the two spokes 84 of wheel 2 closest to the ground are angularly disposed thereto, as shown in FIG. 4. This out of phase relationship causes the present walker to be advanced in a step-wise manner when the patient alternately applies a downward force on side bars 10 and 12 as he shifts his weight from one side to the other as he walks, the walker being advanced a distance equal to one-half the circumferential distance between spokes 84 of spoke wheels 2 and 4. By this arrangement, the walker advances forwardly in short distant increments, thereby accommodating a patient who is able to walk forward in only short steps with the assistance of a walking aid.

The out of phase attachment of the spoked wheels additionally allows the patient to rest, and yet be supported by the frame since one of the wheels always has spokes angularly disposed to the ground to prevent rotation of the wheels.

The walker of the present invention is particularly useful for those who must constantly support themselves with their arms and are unable to lift a walker or walking aid off the ground. With the present invention, the patient may advance the walker by merely shifting his weight from one side of the walker to the other while continuing to be braced against the side bars of the walker frame at all times.

To advance the walker, it is only necessary that the patient stand in the space between side bars 10 and 12 and grasp hand grips 18 and 20. When the walker is in the position illustrated in the drawing, spoked wheel 2 is disposed with 2 adjacent spokes 84 angularly engaging the ground at approximately a 30° angle and spoked wheel 4 has a single spoke in perpendicular engagement with the ground. The patient then shifts his weight to side bar 12 which causes movement of spoked wheels 2 and 4 in a direction to relocate the lowermost spoke of spoked wheel 4 from its perpendicular position to an angular position, and simultaneously position a spoke 84 of spoked wheel 2 in perpendicular engagement with the ground. This movement is also accompanied by a sideways rocking movement of the entire walker which simulates the corresponding side movement of the patient as he moves forward one step at a time and alternately exerts a downward force on the side bars of the walker frame.

The degree of rotational movement of the spoked wheels determines the distance forward which the walker advances, the 8 spoke arrangement disclosed in the drawing having been found to produce a forward movement of the walker of approximately 4 inches. The increment of movement of the walker may therefore be modified by employing fewer spokes to produce a longer increment of movement, or more spokes to produce a shorter increment.

By virtue of the engagement of the wheel assemblies with front leg extensions 46 and 48, replacement of the wheel assemblies and leg extension as a unit, and replacement by another size unit, may be readily carried out in a minimum of time.

The present invention provides an economical arrangement for producing a step-by-step forward movement of a conventional walker, by application of spoked wheel assemblies which obviate the necessity of lifting the walker in order to produce forward movement thereof by translating the downward forces on the side bars of the walker frame which are produced by the shifting of weight of the patient to a forward movement of the walker in controlled increments of short length.

Although there has been herein shown and described the present preferred form of this invention, it is to be understood that such has been done for purposes of illustration only, and that various changes may be made therein within the scope of the appended claims.

What is claimed is:

1. A walker comprising (a) an upstanding frame including right and left hand support portions (b) each of said support portions comprising front and rear ground-engaging members for stabilizing the walker (c) bearing means associated with the lower part of each of said right and left hand support portions (d) an axle rotatably carried by said bearing means spanning said support portions, and (e) a hub fixedly secured to each end of said axle (f) said front ground-engaging members including a plurality of equally spaced spokes extending radially outwardly from said hub (g) the spokes on one hub being substantially one-half step out of phase with the spokes on the other hub, whereby, when one of the spokes of said one hub is substantially perpendicular to, and in engagement with the ground, two of the spokes of said other hub are angularly disposed to, and in engagement with, the ground so that the walker can be stably advanced in stepwise increments in response to downward forces alternately applied by the patient to the right and left hand support portions of the frame.

2. The walker of claim 1, with the addition of (a) tips of non-skid material fixed to the outer ends of said spokes.

3. The walker of claim 1, wherein (a) said front ground-engaging members further include stabilizing feet on the lower end of said frame.

4. The walker of claim 1, with the addition of (a) adjustable and removable extensions engaged with said frame to vary the height thereof.

5. The walker of claim 4, wherein (a) said bearing means are fixed to said extensions, whereby said extensions, axle, hubs and spokes may be removed and replaced as a unit.

6. The walker of claim 1, wherein (a) said frame includes a rear portion comprising a forward transverse horizontal section, the ends of which extend rearwardly to provide opposed horizontal side bars, (b) rear legs extending downwardly from the aft end of said side bars (c) said frame further including a front portion of inverted U-shape comprising a horizontal section, the ends of which extend downwardly to provide front legs, and (d) means for securing the horizontal section of said rear portion to the horizontal section of said front portion.

7. The walker of claim 6, with the addition of (a) adjustable and removable extensions engaged with said front and rear legs to vary the height of said frame.

8. The walker of claim 7, wherein (a) said bearing means are fixed to said extensions, whereby said extensions, axle, hubs and spokes may be removed and replaced as a unit.

* * * * *